US008616218B2

(12) United States Patent
Koshiishi

(10) Patent No.: US 8,616,218 B2
(45) Date of Patent: Dec. 31, 2013

(54) TOBACCO FILTER

(76) Inventor: Kazuto Koshiishi, Yamanashi (JP)

( * ) Notice: Subject to any disclaimer, the term of this patent is extended or adjusted under 35 U.S.C. 154(b) by 165 days.

(21) Appl. No.: 13/000,087

(22) PCT Filed: Jul. 1, 2008

(86) PCT No.: PCT/JP2008/062253

§ 371 (c)(1),
(2), (4) Date: Dec. 20, 2010

(87) PCT Pub. No.: WO2010/001489

PCT Pub. Date: Jan. 7, 2010

(65) Prior Publication Data

US 2011/0088709 A1 Apr. 21, 2011

(51) Int. Cl.
*A24D 3/00* (2006.01)

(52) U.S. Cl.
USPC ..... 131/201; 131/338; 131/339; 131/340

(58) Field of Classification Search
USPC ..... 131/338, 339, 340, 201
See application file for complete search history.

(56) References Cited

U.S. PATENT DOCUMENTS

| | | | | |
|---|---|---|---|---|
| 1,904,814 | A * | 4/1933 | Anzelewitz | 131/188 |
| 2,402,680 | A * | 6/1946 | Schmitt | 131/188 |
| 3,058,476 | A * | 10/1962 | Atkins | 131/187 |
| 3,144,023 | A * | 8/1964 | Morceau | 131/189 |
| 3,926,199 | A * | 12/1975 | Thomas | 131/187 |
| 3,958,579 | A * | 5/1976 | Baker | 131/339 |
| 4,209,026 | A * | 6/1980 | Dock | 131/187 |
| 4,582,072 | A | 4/1986 | Sanford | |
| 4,856,540 | A * | 8/1989 | Jansma et al. | 131/339 |
| H1271 | H * | 1/1994 | Shouse | 131/86 |
| 2004/0154629 | A1 | 8/2004 | Sampson | |

FOREIGN PATENT DOCUMENTS

| | | | |
|---|---|---|---|
| JP | 48052999 | A | 7/1973 |
| JP | 61015677 | A | 1/1986 |
| JP | 05-023158 | A | 2/1993 |
| JP | 6-53396 | U | 8/1994 |
| JP | 2001-120250 | A | 5/2001 |
| JP | 4044731 | B2 | 2/2008 |

OTHER PUBLICATIONS

ISR for PCT/JP2008/062253 mailed Oct. 28, 2008.

* cited by examiner

*Primary Examiner* — Richard Crispino
*Assistant Examiner* — Dionne Walls Mayes
(74) *Attorney, Agent, or Firm* — Lowe, Hauptman & Ham LLP

(57) ABSTRACT

A tobacco filter which can easily produce a hand-rolled cigarette, can suppress excessive heat conduction to a smoker's lips, and can suppress spoiling of tobacco taste during smoking is provided. A tobacco filter for producing a hand-rolled cigarette by wrapping at least a portion thereof together with a smoking plant with a wrapping paper has an outer surface on which grooves are formed and a smoke channel. The tobacco filter is made of an incombustible material. A surface area of an outer surface of the tobacco filter is increased due to the formation of the grooves so that the tobacco filter can be efficiently cooled and the excessive heat conduction to a smoker's lips can be suppressed. In wrapping the tobacco filter with the wrapping paper, inward folding lines are formed on the wrapping paper by corner portions of the tobacco filter.

14 Claims, 14 Drawing Sheets

TOBACCO FILTER

RELATED APPLICATIONS

The present application is national phase of, and claims priority from, International Application Number PCT/JP2008/062253, filed Jul. 1, 2008.

TECHNICAL FIELD

The present invention relates to a tobacco filter used in producing a hand-rolled cigarette by wrapping a smoking plant such as tobacco leaves or herbs for smoking with a wrapping paper. To be more specific, the present invention relates to a tobacco filter having a shape which enables easy wrapping of a wrapping paper around a smoking plant and enhancing absorption of harmful substances such as tars when smoking.

BACKGROUND ART

In producing a hand-rolled cigarette with a filter, tobacco leaves, a wrapping paper and a filter are used. A popularly-used filter of the hand-rolled cigarette has the same size as the commercially available cigarette, that is, is small and short. Because of being small and short, the production of a hand-rolled cigarette with a filter using the hands requires a skill to some extent. To compensate for this insufficient skill, it is often the case where a personal tobacco wrapping device is used in the production of a hand-rolled cigarette with a filter.

The personal tobacco wrapping device is explained in conjunction with FIG. 13 and FIG. 14. FIG. 13 is a top plan view of the personal tobacco wrapping device 40. As shown in FIG. 13, the personal tobacco wrapping device 40 includes a fixed tobacco-wrapping roller 22A, a movable tobacco-wrapping roller 22B, a tobacco-wrapping belt (not shown in FIG. 13) and a frame 25.

FIG. 14 is a perspective view of the personal tobacco wrapping device 40 where the frame 25 is not shown in the drawing. As shown in FIG. 14, the fixed tobacco-wrapping roller 22A and the movable tobacco-wrapping roller 22B have a columnar shape respectively, and a shaft 24A of the fixed tobacco-wrapping roller 22A and a shaft 24B of the movable tobacco-wrapping roller 22B are arranged parallel to each other. Further, as shown in FIG. 13, both ends of the shafts 24A, 24B axially project from the fixed tobacco-wrapping roller 22A and the movable tobacco-wrapping roller 22B respectively, and are mounted on the frame 25 such that the fixed tobacco-wrapping roller 22A and the movable tobacco-wrapping roller 22B are not disengaged from the frame 25.

The fixed tobacco-wrapping roller 22A is rotatable about the shaft 24A, and the movable tobacco-wrapping roller 22B is rotatable about the shaft 24B. Further, as shown in FIG. 13 and FIG. 14, a smoker can make the movable tobacco-wrapping roller 22B approach the fixed tobacco-wrapping roller 22A by pushing the movable tobacco-wrapping roller 22B with his finger or the like. Here, the shaft 24B moves along elongated holes (not shown in the drawing) formed in the frame 25 and approaches the shaft 24A. As a result, the movable tobacco-wrapping roller 22B moves in the direction toward the fixed tobacco-wrapping roller 22A.

Further, the movable tobacco-wrapping roller 223 can move in the opposite direction as well. In other words, the movable tobacco-wrapping roller 22B can make a separating movement where the movable tobacco-wrapping roller 22B is separated from the fixed tobacco-wrapping roller 22A. Here, the rotational movement of the movable tobacco-wrapping roller 22B and the approaching and separating movement of the movable tobacco-wrapping roller 22B in the direction toward and away from the fixed tobacco-wrapping roller 22A are independent from each other.

As shown in FIG. 14, the tobacco-wrapping belt 23 is arranged such that the tobacco-wrapping belt 23 wraps the fixed tobacco-wrapping roller 22A and the movable tobacco-wrapping roller 22B. Further, as shown in FIG. 15 and FIG. 16, the tobacco-wrapping belt 23 has a length which is sufficient for pressing tobacco leaves and a filter for producing one piece of hand-rolled cigarette in a space defined between the fixed tobacco-wrapping roller 22A and the movable tobacco-wrapping roller 22B. Here, the direction that the "length" is taken is perpendicular to the direction that a width "e" shown in FIG. 13 and FIG. 14 is taken.

Next, by reference to FIG. 15 to FIG. 19, steps of producing the hand-rolled cigarette with a filter using the personal tobacco wrapping device 40 are explained. FIG. 15 to FIG. 19 are schematic cross-sectional views of the personal tobacco wrapping device 40 shown in FIG. 13 taken along a line f-f. Firstly, as shown in FIG. 15, in a state where the fixed tobacco-wrapping roller 22A and the movable tobacco-wrapping roller 22B are separated from each other, a proper amount of tobacco leaves 7A and a columnar filter (not shown in the drawing) are aligned with each other on the tobacco-wrapping belt 23. Then, the tobacco leaves 7A and the filter are pressed into the space defined between two rollers 22A, 22B from above the tobacco-wrapping belt 23. After the tobacco leaves 7A and the filter are pushed into the space defined below two rollers 22A, 22B, the movable tobacco-wrapping roller 22B is made to approach the fixed tobacco-wrapping roller 22A. In this manner, as shown in FIG. 16, the tobacco leaves 7A and the filter are accommodated in a space defined below two rollers 22A, 22B.

Then, by rotating two rollers 22A, 22B in the directions indicated by arrows in FIG. 16, the tobacco-wrapping belt 23 is moved along peripheries of the tobacco leaves 7A and the filter. Due to such movement of the tobacco-wrapping belt 23, the tobacco leaves 7A are formed into a columnar shape together with the filter.

Then, as shown in FIG. 17, a rectangular wrapping paper 2 is inserted into the space through a gap defined between the two rollers 22A, 22B and two rollers 22A, 22B are rotated. Here, the rotational directions of two rollers 22A, 22B are the directions indicated by the arrows in FIG. 16. Here, an adhesive strip is formed on one end of one surface of the wrapping paper 2. By rotating two rollers 22A, 22B, the tobacco leaves 7A formed into a columnar shape and the filter are wrapped with the wrapping paper 2 in several layers.

As shown in FIG. 18, in a state where only a portion of the wrapping paper 2 still projects from the gap between two rollers 22A, 22B, the rotation of two rollers 22A, 22B is stopped temporarily, and the adhesive strip 26 formed on a portion of the wrapping paper 2 which projects from the gap between two rollers 22A, 22B is made wet with saliva or the like. Then, two rollers 22A, 22B are further rotated thus feeding the portion of the wrapping paper 2 on which the adhesive strip 26 is formed into a space defined below two rollers 22A, 22B. Accordingly, the adhesive strip 26 is adhered to another portion of the wrapping paper 2 so that it is possible to produce a hand-rolled cigarette where the tobacco leaves 7A and the filter are wrapped with the wrapping paper 2 in several layers. Finally, as shown in FIG. 19, by separating the movable tobacco-wrapping roller 22B from the fixed tobacco-wrapping roller 22A, the produced hand-rolled cigarette is taken out from the personal tobacco wrapping device 40.

When the hand-rolled cigarette is produced by using the personal tobacco wrapping device 40, a length of the hand-rolled cigarette is determined based on the inner width "e" of the personal tobacco wrapping device 40 shown in FIG. 13 and FIG. 14. Accordingly, a length of the filter which is used together with the tobacco leaves is also limited so that a large-sized filter cannot be used in the production of the hand-rolled cigarette.

Further, in the hand-rolled cigarette produced by using the personal tobacco wrapping device 40, the wrapping paper 2 wraps the tobacco leaves 7A and the filter several layers. Accordingly, compared with a hand-rolled cigarette where the wrapping paper wraps tobacco leaves and a filter in one layer, the consumption of the wrapping paper in smoking is large and, further, a taste of the hand-rolled cigarette which a smoker enjoys by smoking is spoiled. On the other hand, as a method for producing a hand-rolled cigarette which can suppress the consumption of a wrapping paper and allows a smoker to enjoy a taste of the hand-rolled cigarette by smoking, there has been known a reverse wrapping method.

By reference to FIG. 20, FIG. 21, FIG. 22 and FIG. 23, the reverse wrapping method is explained. Firstly, as shown in FIG. 20, wrapping of tobacco leaves 7A with a wrapping paper 2 starts from an end portion of the wrapping paper 2 on a side where an adhesive strip 26 is formed in such a manner that a surface of the wrapping paper 2 on which the adhesive strip 26 is formed faces an outer side of tobacco leaves 7A. Then, as shown in FIG. 21 and FIG. 22, when the wrapping paper 2 wraps around the tobacco leaves (not shown in the drawing) one time and overlaps with a surface of the adhesive strip 26, the wrapping paper 2 is made wet from outside the overlapped portions thereof so that overlapped portions of the wrapping paper 2 are adhered to each other. Then, as shown in FIG. 23, an unnecessary portion of the wrapping paper 2 is cut away.

When the hand-rolled cigarette is produced by the reverse wrapping method using a personal tobacco wrapping device, the wrapping paper is inserted into the personal tobacco wrapping device in a state where the surface of the adhesive strip which faces the outside is made wet. In this case, the wrapping paper is adhered to constitutional parts of the personal tobacco wrapping device. For this reason, it is substantially impossible to produce the hand-rolled cigarette by the reverse wrapping method using the personal tobacco wrapping device.

Further, at the portion of the wrapping paper on which the adhesive strip is formed, an adhesive agent is applied to only one surface of the wrapping paper. Accordingly, a shrinkage rate of the wrapping paper due to drying of the wrapping paper differs between the surface of the wrapping paper to which the adhesive agent is applied and the surface of the wrapping paper to which the adhesive agent is not applied. For this reason, when the wrapping paper is stored for a long time, the wrapping paper curls with the adhesive strip directed inwardly. Accordingly, as shown in FIG. 24, it is difficult to produce the hand-rolled cigarette by the reverse wrapping method using the wrapping paper 2 which is bent in the direction toward the adhesive strip 26 and a general filter (not shown in the drawing).

As a filter of a cigarette used in general, there have been known a fibrous filter shown in FIG. 25 which has a cylindrical shape and is also used in a commercially available cigarette, a plastic-made filter shown in FIG. 26 which is called "tip" and has a hollow and substantially frustoconical shape, and a filter shown in FIG. 27 which is called "roach" and is formed by rolling a rectangular paper 21 in a cylindrical shape. The sizes of all these filters are substantially equal to the size of the filter of the commercially available cigarette. FIG. 27 is a schematic view showing steps of producing the roach. As shown in FIG. 27, the roach rolled into a columnar shape is produced by rotating the rectangular paper 21.

The production of the hand-rolled cigarette using an aluminum-made cylindrical filter shown in FIG. 28 having a diameter "g" of 8 mm and a length "h" of 20 mm which are substantially equal to corresponding sizes of a filter of a commercially available cigarette is most excellent in terms of an advantage that the filter can be used repeatedly, an advantage that the personal tobacco wrapping device can be used for producing the hand-rolled cigarette, and an advantage that a wrapping paper is completely burnt or tobacco leaves are completely consumed. However, in the hand-rolled cigarette which uses such a filter, a substance such as tar which is generated when tobacco leaves are burnt, is harmful and spoils tobacco taste is liable to pass the filter. Accordingly, the taste of cigarette is spoiled before the tobacco leaves are not burnt to an area close to the filter. Further, a smoker's lips may feel hot while smoking due to heat conduction from smoke generated by burning of tobacco leaves.

To suppress spoiling of tobacco taste and the excessive heat conduction to the smoker' s lips during smoking, it may be possible to simply elongate the filter in such a manner that a length of the filter is set to approximately 70 mm, for example. The elongation of the filter can suppress spoiling of tobacco taste and the excessive heat conduction to the smoker's lips. However, a commercially available personal tobacco wrapping device does not have a width sufficient to allow the use of the elongated filter and hence, there may be a case where the hand-rolled cigarette cannot be produced using the personal tobacco wrapping device.

In this case, a smoker produces the hand-rolled cigarette by wrapping tobacco leaves manually with a wrapping paper without using the personal tobacco wrapping device. However, a surface of the aluminum-made filter is slippery so that the wrapping paper slips on the surface of the filter. Accordingly, it is difficult for the smoker to wrap the tobacco leaves with the wrapping paper. Further, even if the wrapping paper can be wrapped around the filter, the wrapping paper and the tobacco leaves are liable to be removed from the filter.

DISCLOSURE OF INVENTION

Task to be Solved by the Invention

The present invention has been made under such circumstances, and it is an object of the present invention to provide a tobacco filter which enables the easy production of a hand-rolled cigarette without using a personal tobacco wrapping device, can suppress excessive heat conduction to a smoker's lips, and can suppress spoiling of tobacco taste during smoking.

Means for Solving the Task

According to one aspect of the present invention, there is provided a tobacco filter used for producing a hand-rolled cigarette by wrapping at least a portion thereof together with a smoking plant with a wrapping paper, wherein the tobacco filter has an uneven outer surface and a hollow portion which forms a smoke channel, and is made of an incombustible material. Due to the tobacco filter according to one aspect of the present invention, the hand-rolled cigarette can be produced easily, and it is also possible to suppress excessive heat conduction to a smoker's lips and spoiling of tobacco taste during smoking.

The uneven outer surface may be an outer surface on which grooves are formed. An air hole through which air which is taken into the hollow portion from an end portion of the tobacco filter which constitutes a smoker side when the hand-rolled cigarette is produced is guided to the outside may be formed in the tobacco filter at a position in the vicinity of the smoking plant when the hand-rolled cigarette is produced. A diameter of an end portion of the tobacco filter which constitutes a smoking plant side when the hand-rolled cigarette is produced may be set larger than a diameter of the end portion of the tobacco filter which constitutes the smoker side when the hand-rolled cigarette is produced.

The tobacco filter may further include an adhesion member which is made of an incombustible material, which is being inserted into the hollow portion during smoking and to which at least a portion of a substance which is produced when the smoking plant is burnt is adhered. The adhesion member may have an elongated plate shape or a shape which is formed by twisting an elongated plate along the longitudinal direction. The tobacco filter may have a multi-faceted columnar profile ranging from a pentagonal columnar profile to an octagonal columnar profile. The hollow portion may have a circular column shape. A surface of the hollow portion may be formed of a smooth surface.

Advantage of the Invention

In smoking a commercially available tobacco, a smoker can enjoy smoking by merely taking out a tobacco from a box in which tobaccos are packed, putting the tobacco in his mouth, and lighting up the tobacco. These steps are so simple steps requiring neither time nor skill that the smoker performs these steps unconsciously. This easiness of the steps makes a smoker increase an intake amount of nicotine and also makes a smoker addicted to nicotine.

It is not a rare case where a smoker stops smoking by asking himself whether he really wants nicotine or he smokes against his better judgment when he feels a need for something to put in his mouth. Stop of smoking against the smoker's will imposes a heavy stress on the smoker so that it is desirable for the smoker to break himself of that habit and to start stopping of smoking from the non-forced reduction of smoking firstly.

One of methods which allow a smoker to control an intake amount of nicotine without being controlled by a smoking habit is the use of hand-rolled cigarettes. An operation which produces a hand-rolled cigarette by wrapping a wrapping paper on a smoking plant and a filter takes some time and hence, unless a smoker really wants to smoke, he does not perform a paper wrapping operation. Further, smoking after producing a hand-rolled cigarette by wrapping a wrapping paper on a smoking plant and a filter is impossible during walking or during driving of a car and hence, a smoking amount is surely reduced.

According to the present invention, it is possible to easily produce the hand-rolled cigarette which can suppress a change of cigarette taste during smoking without using a personal tobacco wrapping device. Eventually, the smoker can suppress his smoking to an amount not exceeding a necessary amount so that the smoker can reduce his smoking. Further, according to the present invention, it is possible to suppress excessive heat conduction to the smoker's lips. Still further, according to the present invention, tobacco leaves can be completely burnt and the filter can be reused and hence, the reduction of dusts can be realized. Still further, according to the present invention, a smoker produces the hand-rolled cigarette using his finger tips several times every day so that the brain of the smoker is stimulated thus preventing cognitive impairment due to aging.

| Explanation of Symbols | |
|---|---|
| 1: | tobacco filter |
| 2: | wrapping paper |
| 3: | corner portion |
| 4: | external surface |
| 5: | groove |
| 6: | smoke channel |
| 7A, 7B: | tobacco leaves |

BEST MODE FOR CARRYING OUT THE INVENTION

Hereinafter, respective embodiments of the present invention are explained in conjunction with drawings. In the second embodiment and other embodiments which follow, the repeated explanations are omitted when appropriate.

(First Embodiment)

Figure 1:
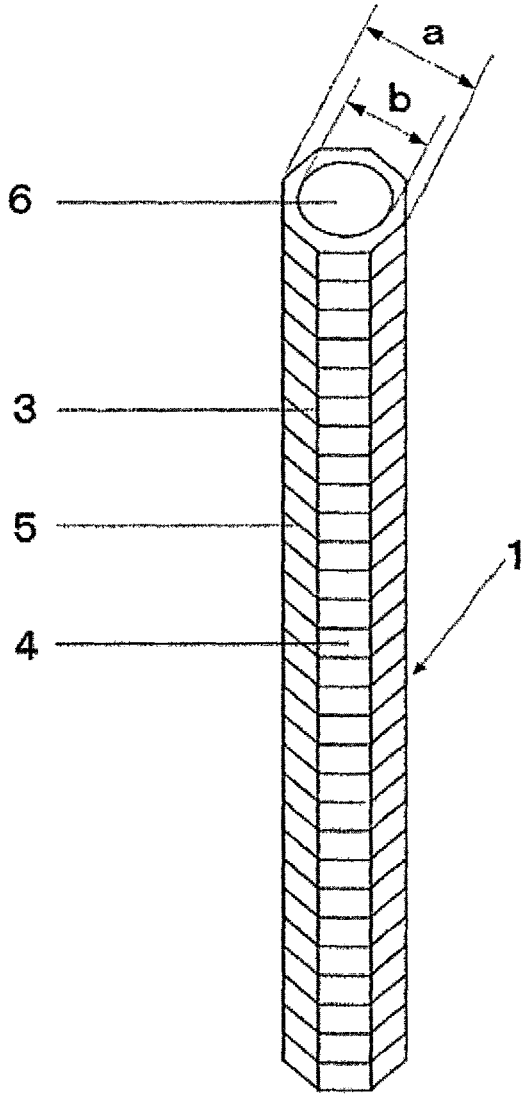
FIG. 1 is an external view of a tobacco filter of a first embodiment.

FIG. 1 shows a tobacco filter 1 according to the first embodiment of the present invention. The tobacco filter 1 is used for producing a hand-rolled cigarette which is formed by wrapping a portion thereof together with a smoking plant such as tobacco leaves or smoking herbs with a wrapping paper. The tobacco filter 1 has an octagonal columnar shape shown in FIG. 1 where a diameter "a" of the tobacco filter 1 is set to 4.5 mm and a height of the tobacco filter 1 is set to 70 mm. A columnar hollow portion having a diameter "b" of 3 mm is formed in the tobacco filter 1 as shown in FIG. 1. The hollow portion functions as a smoke channel 6.

By forming a profile of the tobacco filter 1 into a multi-faceted column such as an octagonal column, at the time of wrapping the wrapping paper around the tobacco filter 1, it is possible to form folding lines inwardly by pushing the wrapping paper onto corner portions of a surface of the multi-faceted column. Accordingly, the hand-rolled cigarette can be easily produced. To prevent an inward folding angle of the wrapping paper from becoming too sharp, it is preferable that the tobacco filter 1 has a multi-faceted columnar profile which is a pentagonal or more columnar profile. Further, from a viewpoint of ease in production and working and prevention of falling of the tobacco filter 1 when the tobacco filter 1 is placed on a desk or the like, it is preferable that the tobacco filter 1 has a multi-faceted columnar profile which is an octagonal or less columnar profile. In the present invention, the multi-faceted column includes a column whose corner portions are curved or rounded. In this embodiment, the profile of the tobacco filter 1 is formed of the octagonal column. However, from a viewpoint of prevention of falling of the tobacco filter 1 when the tobacco filter 1 is placed on a desk or the like, the profile of the tobacco filter 1 may be formed of an elliptical column, a circular column having one or more corner portions on a side surface thereof or a multi-faceted column.

The tobacco filter 1 has an uneven outer surface 4. In the present invention, "outer surface" designates a main surface of the tobacco filter 1 such as side surfaces of the circular column or the multi-faceted column. In other words, the "outer surface" does not include a bottom surface of the circular column or the multi-faceted column. By providing the uneven outer surface 4 to the tobacco filter 1, compared to a tobacco filter which has a flat outer surface 4, a surface area of the outer surface 4 is increased so that a contact area of the tobacco filter 1 with outside air is increased. As a result, the tobacco filter 1 is efficiently cooled, and an mount of harmful substance such as tar adhered to the tobacco filter 1 during smoking can be increased. The bottom surface of the tobacco filter 1 may be either flat or uneven.

The tobacco filter 1 according to this embodiment adopts the outer surface 4 having grooves 5 as the uneven outer surface 4. The grooves 5 are formed in such a manner that the grooves 5 surround the outer surface 4 of the tobacco filter 1. Due to such a constitution, in producing the cigarette by wrapping the wrapping paper around the tobacco filter 1, the wrapping paper is scarcely slipped off from the tobacco filter 1. As other uneven outer surfaces, an outer surface which has asperity such as a saw-toothed shape or a triangular wave shape along the longitudinal direction is named. Further, the asperity may be formed on the outer surface of the tobacco filter 1 along the circumferential direction.

The tobacco filter 1 is made of an incombustible material so that a smoker can enjoy smoking by burning substantially all wrapping paper and all tobacco leaves. Accordingly, there is substantially no wasteful consumption of the wrapping paper and tobacco leaves. Further, different from a filter made of paper or the like, the filter made of an incombustible material is not a disposal type but can be reused and hence, the reduction of waste and the preservation of global environment can be realized.

As the incombustible material, metal, ore, ceramics or an inorganic material such as porcelain can be used. Further, the incombustible material may preferably have high thermal conductivity and high formability. Still further, respective parts of the tobacco filter may be made of different materials. For example, the tobacco filter may be formed such that a portion of the tobacco filter which touches a smoker's lips is made of a material which has lower thermal conductivity and a portion of the tobacco filter close to tobacco leaves is made of a material which has higher thermal conductivity, or a surface of the tobacco filter is made of a material which has lower thermal conductivity and the inside of the tobacco filter is made of a material which has high thermal conductivity.

The tobacco filter 1 of this embodiment is made of 18K gold which is an alloy formed by mixing 15% of silver and 10% of copper into 24K gold. Besides 18K gold which is an alloy formed by mixing 15% of silver and 10% of copper into 24K gold, the tobacco filter 1 may be made of other materials such as 18K gold which is an alloy formed by mixing 25% of other metals into 24K gold, pure gold, hardened pure gold with purity of 99.9%, pure silver, silver 925 with a rhodium plated surface and platinum. 18K gold is superior to 24K gold in terms of high hardness, and silver 925 with a rhodium plated surface is superior to pure silver in terms of oxidation resistance.

Further, the thermal conductivity of a surface of silver 925 with a lutetium plated surface is considerably small compared to the thermal conductivity of the surface of silver 925 with a rhodium plated surface. Accordingly, the tobacco filter 1 made of silver 925 with a lutetium plated surface is superior to the tobacco filter 1 made of silver 925 with a lutetium plated surface in heat insulation in a cooled state. Further, platinum exhibits low thermal conductivity so that platinum is not easily heated whereby platinum is excellent as a material for forming a portion of the tobacco filter 1 which touches a smoker's lips. The thermal conductivities of various incombustible materials which can be used for forming the tobacco filter 1 are shown in the following table.

| incombustible material | thermal conductivity (W/cm · K) |
|---|---|
| carbon (diamond) | 20-30 |
| silver | 4.29 |
| copper | 4.01 |
| gold | 3.17 |
| aluminum | 2.37 |
| rhodium | 1.50 |
| chromium | 0.94 |
| nickel | 0.91 |
| iron | 0.80 |
| palladium | 0.72 |
| platinum | 0.72 |
| titanium | 0.22 |
| lutetium | 0.16 |

It is desirable that the smoke channel 6 has a smooth surface. When a smoker continues smoking in a state where a harmful substance such as tar is adhered to the surface of the smoke channel 6 during smoking, cigarette taste is gradually spoiled. To the contrary, when the surface of the smoke channel 6 is smooth, a harmful substance such as tar can be easily removed by cleaning the smoke channel 6. When the surface of the smoke channel 6 is smooth, to focus on the adhesion of a harmful substance such as tar to the surface of the smoke channel 6 during smoking, the harmful substance is adhered to the whole surface of the smoke channel 6 substantially evenly and hence, the smoke channel 6 is scarcely clogged by the harmful substance whereby spoiling of the cigarette taste can be delayed.

Provided that the smoke channel 6 functions as a smoke channel, the hollow portion formed in the tobacco filter 1 may take any shape. However, it is desirable that the hollow portion has a circular columnar shape. By forming the hollow portion into a circular columnar shape, to focus on the adhesion of a harmful substance such as tar to the surface of the smoke channel 6 during smoking, the harmful substance is adhered to the whole surface of the smoke channel 6 substantially evenly and hence, the smoke channel 6 is scarcely clogged by the harmful substance whereby spoiling of the cigarette taste can be delayed.

Further, to make the cleaning of the smoke channel 6 after smoking easier, it is desirable to produce the tobacco filter 1 while applying low friction forming to the surface of the smoke channel 6. Here, the low friction forming is forming which brings the surface of the smoke channel 6 into a smooth state where there is substantially no scratches and grooves on the surface of the smoke channel 6. The low friction forming of the surface of the smoke channel 6 is applied by polishing.

Next, the manufacturing method of the tobacco filter 1 is explained. Firstly, a member having a length half of a length of the tobacco filter 1 is produced by casting metal which is a material for forming the tobacco filter 1 such as silver 925, for example, using a lost wax method. Then, two pieces of thus produced members are joined to each other by blazing. Then, an outer surface of the joined members and a surface of a smoke channel 6 formed in the joined members are polished. Finally, rhodium plating is applied to the outer surface of the joined members and the surface of the smoke channel 6.

Then, the explanation is made with respect to a method of producing a tobacco filter according to another embodiment where the tobacco filter is provided with an outer surface having triangular asperity in the longitudinal direction. Firstly, a laser beam is irradiated to an 18K gold ingot which is a material for forming a tobacco filter thus cutting out a cylinder having an inner diameter of 3 mm and an outer diameter of 5 mm or more (or a thickness of 2 mm or more) and a length of 70 mm or more. Then, the cylinder is cut to have a length of 70 mm. Triangular asperity is formed on an outer surface of the cylinder by cutting. This tobacco filter producing method is mainly used for producing a tobacco filter made of a material such as hardened pure gold, platinum or 18K gold to which plating is not applied in a final step.

Figure 2:
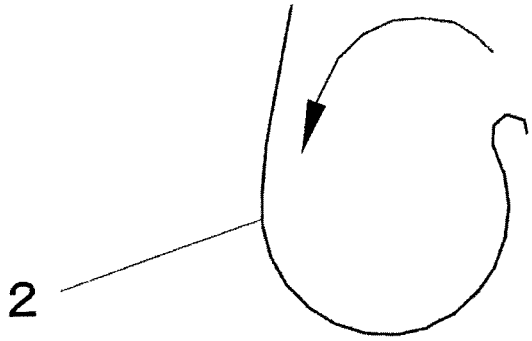
FIG. 2, FIG. 3, FIG. 4 and FIG. 5 are schematic views showing steps of producing a hand-rolled cigarette with a tobacco filter according to the first embodiment.
Figure 3:
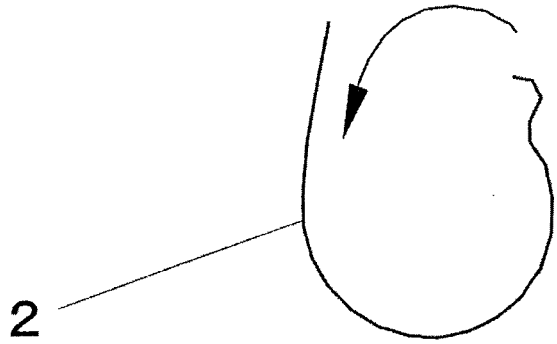
Figure 4:
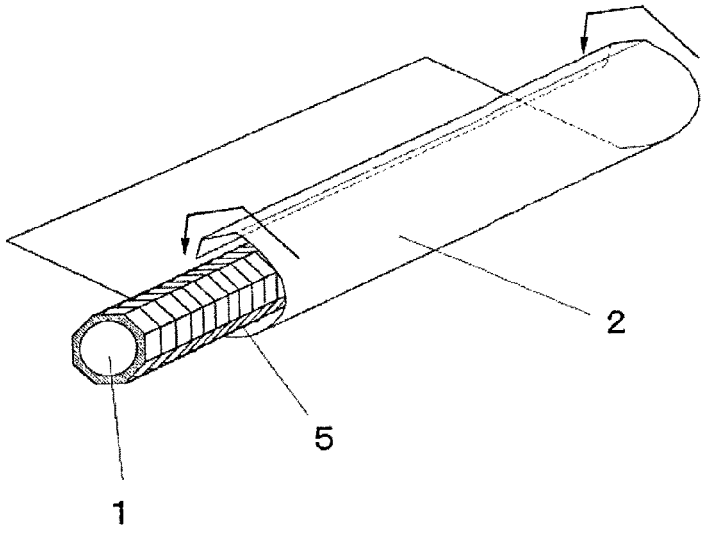

Next, a method of producing hand-rolled cigarette using the tobacco filter 1 is explained. In this embodiment, the hand-rolled cigarette is produced by a reverse wrapping method. Firstly, as shown in FIG. 2 and FIG. 3, the wrapping paper 2 which is dried and curled in the direction toward the adhesive strip (not shown in the drawings) is folded such that an adhesive strip portion is arranged outside. Then, as shown in FIG. 4, the wrapping paper 2 is wrapped around the tobacco filter 1, and the wrapping paper 2 is pushed by the fingers of a smoker so that folding lines are formed on the wrapping paper 2 along an outer profile of the tobacco filter 1.

Figure 5:
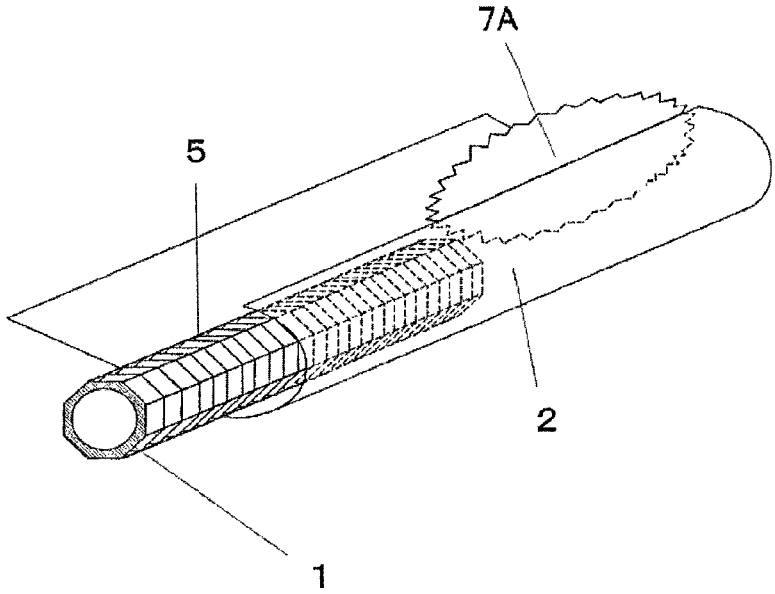

Then, the tobacco filter 1 is moved in the direction that the tobacco filter 1 projects from the wrapping paper 2, and tobacco leaves 7A are stored in the inside of the wrapping paper 2 in a cylindrical shape as shown in FIG. 5. The tobacco leaves 7A are wrapped with the wrapping paper 2 using the tobacco filter 1 as an axis. When the wrapping paper 2 wraps the tobacco leaves 7A one time and portions of the wrapping paper 2 overlap with each other, the portion of the wrapping paper 2 which overlaps from the outside is made wet so as to make both portions of the wrapping paper 2 adhere to each other, and an extra portion of the wrapping paper 2 is cut away. The hand-rolled cigarette which uses the tobacco filter 1 is produced in this manner. Then, a smoker puts the tobacco filter 1 in his mouth, lights up a tip end of the hand-rolled cigarette and smokes.

(Second Embodiment)

Figure 6:
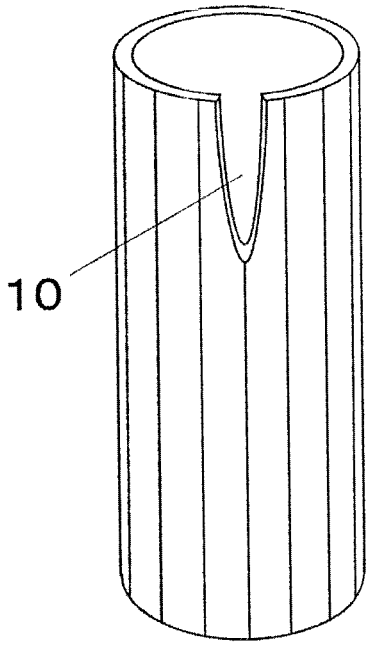
FIG. 6 and FIG. 7 are perspective views of a tobacco filter according to a second embodiment.
Figure 7:
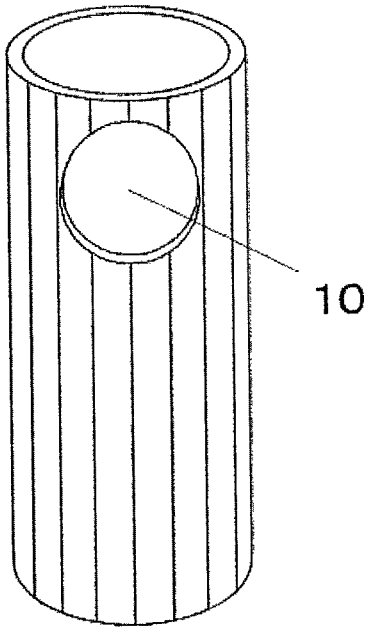

FIG. 6 and FIG. 7 show tobacco filters according to the second embodiment. An air hole 10 is formed in the tobacco filter at a position in the vicinity of tobacco leaves when a hand-rolled cigarette is produced. The position in the vicinity of tobacco leaves implies a position closer to the tobacco leaves than a center position of the tobacco filter in the longitudinal direction. A shape of the air hole 10 may be a notched shape as shown in FIG. 6 or a hole shape as shown in FIG. 7.

Figure 8:
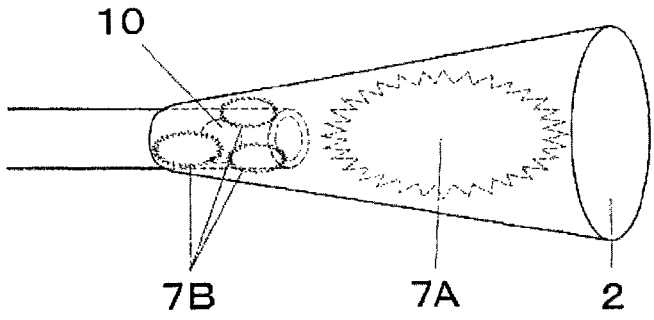
FIG. 8 is a schematic view showing a state of a hand-rolled cigarette during smoking which is produced by using the tobacco filter according to the second embodiment.

When a size of a wrapping paper 2 is small compared to a prepared amount of tobacco leaves 7A, a hand-rolled cigarette may be produced by wrapping the wrapping paper 2 in a conical shape. When the hand-rolled cigarette is produced in this manner, however, as shown in FIG. 8, tobacco leaves 7B may extend over and be present around a periphery of the tobacco filter. By forming the air hole 10 in the tobacco filter in the above manner, air which is taken into the tobacco filter from a smoker's side reaches a space around the tobacco leaves 7B which are present around the tobacco filter through the air hole 10. Accordingly, the tobacco leaves 7B which are present around the tobacco filter can be completely burnt.

(Third Embodiment)

Figure 9:
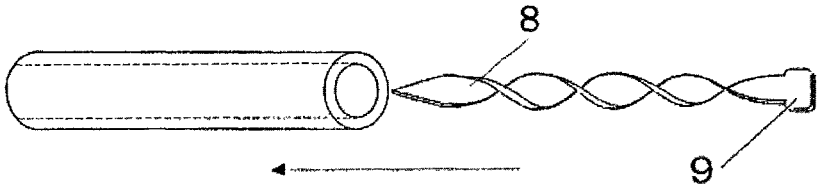
FIG. 9 is a schematic perspective view of a tobacco filter according to a third embodiment.

FIG. 9 shows a tobacco filter according to the third embodiment. The tobacco filter according to this embodiment further includes an adhesion member 8. The adhesion member 8 is made of an incombustible material. The adhesion member 8 is used in an inserting manner into a smoke channel during smoking so that at least a portion of a harmful substance such as tar, for example, which is produced when a smoking plant such as tobacco leaves is burnt is adhered to the adhesion member 8. Here, the adhesion member 8 is inserted into a hand-roiled cigarette from a smoking plant side of the tobacco filter.

Figure 10:
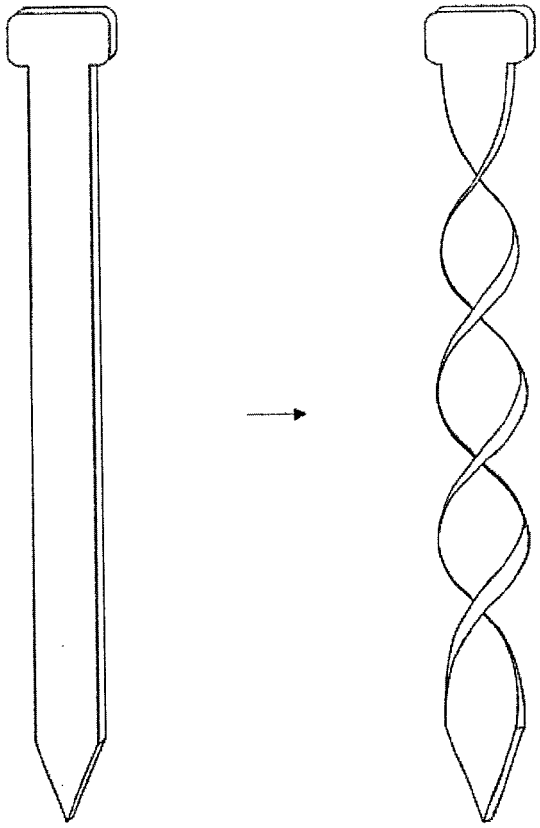
FIG. 10 is an external view of an adhesion member of a tobacco filter of the third embodiment.

The adhesion member 8 has, as shown in FIG. 10, a shape which is formed by twisting an elongated rectangular plate having a width of 2.6 mm and a length of 50 mm spirally along the longitudinal direction. Since the adhesion member 8 has such a shape, the adhesion member 8 can suppress the disturbance of air flow in the smoke channel during smoking whereby a smoker can enjoy comfortable smoking. Further, since the adhesion member 8 has such a shape, a harmful substance such as tar is adhered to the adhesion member 8 uniformly during smoking so that spoiling of cigarette taste can be delayed. It is not always necessary to twist the adhesion member 8 spirally and the adhesion member 8 may directly have an elongated plate shape as shown in FIG. 10.

The adhesion member 8 according to this embodiment is made of silver 925. Besides silver 925, the adhesion member 8 may be made of an incombustible material having high thermal conductivity such as other metals, stone, glass or porcelain. According to the tobacco filter of this embodiment, in the inside of the smoke channel, it is possible to increase a surface area of the adhesion member 8 to which a harmful substance such as tar is adhered with substantially no increase of air resistance in the smoke channel. Then, by taking out the adhesion member 8 from the smoke channel and by cleaning the adhesion member 8, the harmful substance such as tar adhered to the adhesion member 8 can be easily removed.

A stopper 9 is provided to one end of the adhesion member 8. With the use of the stopper 9, it is possible to prevent the adhesion member 8 inserted into the inside of the smoke channel from entering a smoker's mouth during smoking. Steps of producing a hand-rolled cigarette using the tobacco filter according to this embodiment are as follows. Firstly, the adhesion member 8 is inserted into the inside of the smoke channel from a side at which tobacco leaves are mounted on the tobacco filter. Then, a wrapping paper is wrapped around the tobacco filter, and the tobacco leaves are stored in a cylindrical portion of the wrapping paper. Then, overlapping portions of the wrapping paper are adhered to each other.

(Other Embodiments)

Figure 11:
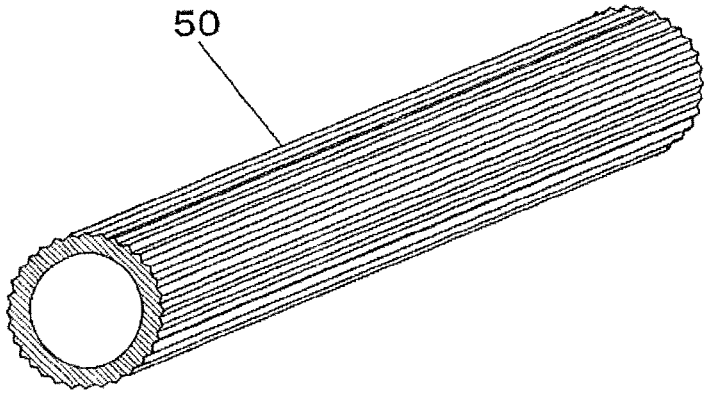
FIG. 11 and FIG. 12 are perspective views of a tobacco filter according to other embodiments.
Figure 12:
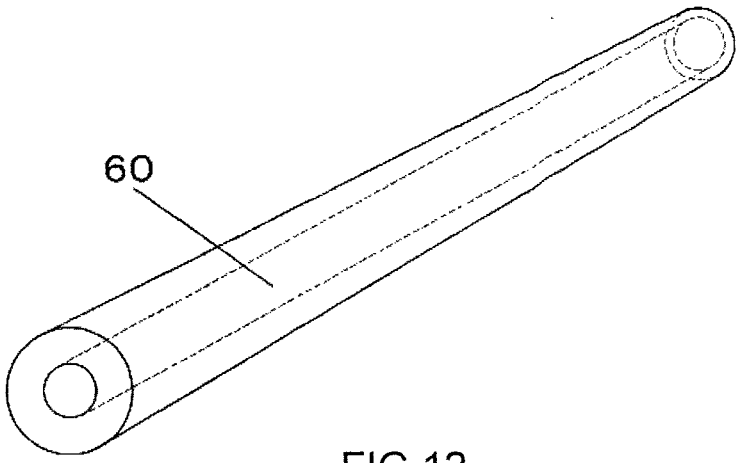
Figure 13:
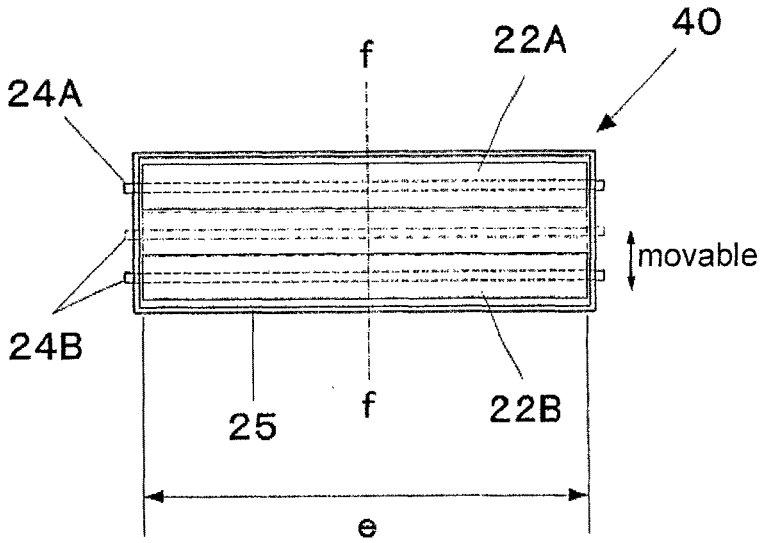
FIG. 13 is a top plan view of a personal tobacco wrapping device.
Figure 14:
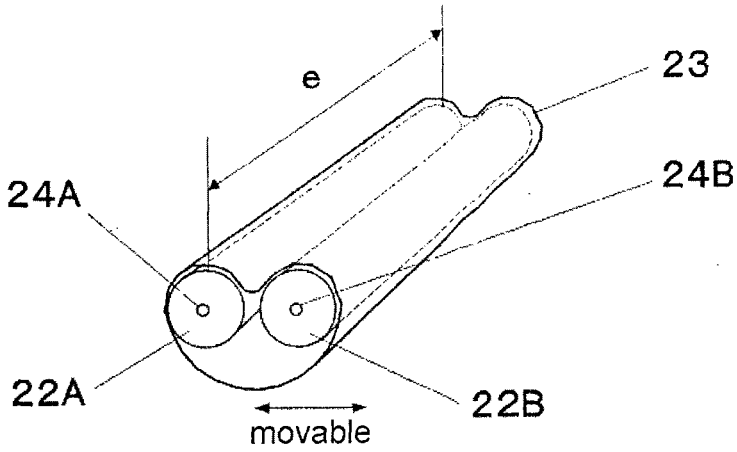
FIG. 14 is a perspective view of the personal tobacco wrapping device.
Figure 15:
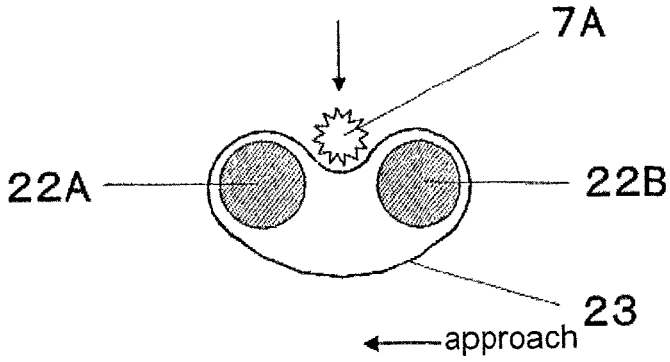
FIG. 15, FIG. 16, FIG. 17, FIG. 18 and FIG. 19 are schematic cross-sectional views of the personal tobacco wrapping device.
Figure 16:
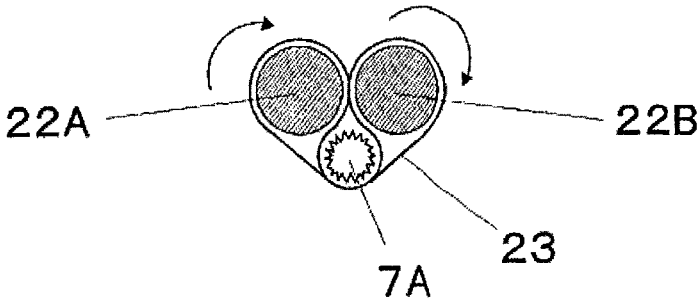
Figure 17:
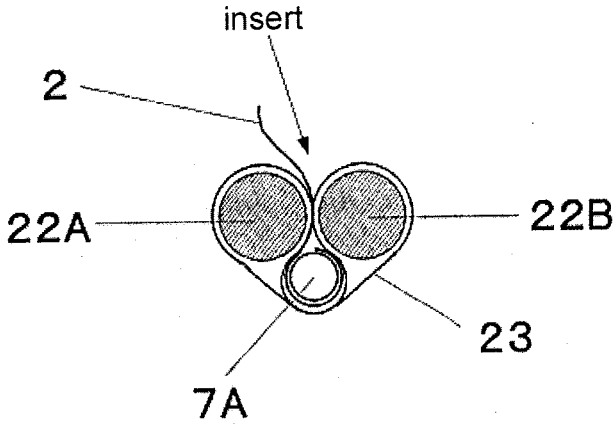
Figure 18:
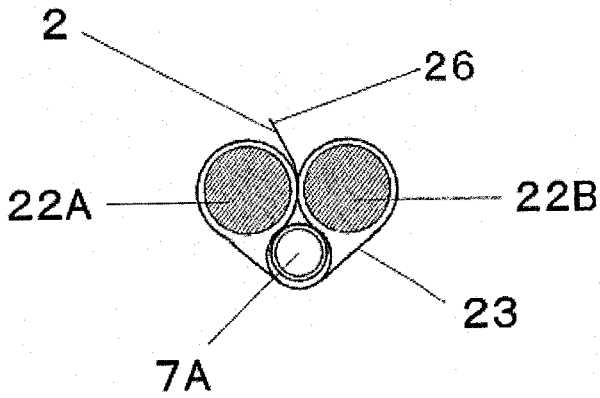
Figure 19:
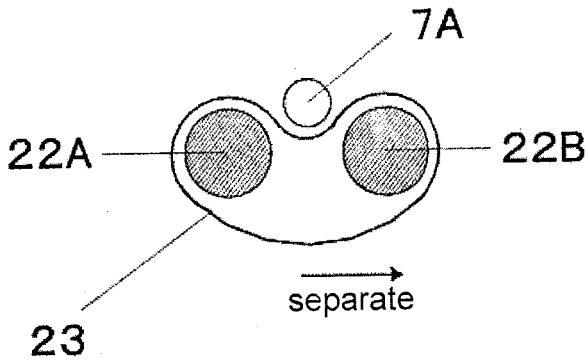
Figure 20:
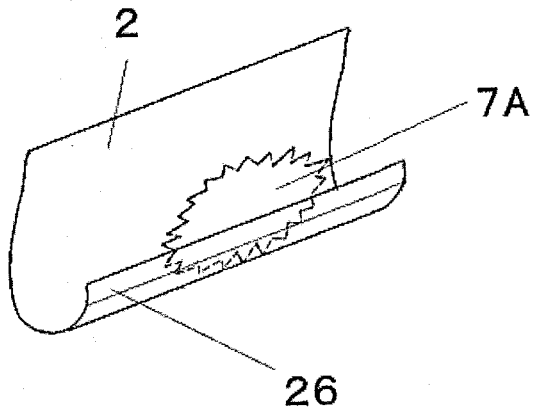
FIG. 20, FIG. 21, FIG. 22 and FIG. 23 are schematic views showing steps of producing a hand-rolled cigarette by a reverse wrapping method.
Figure 21:
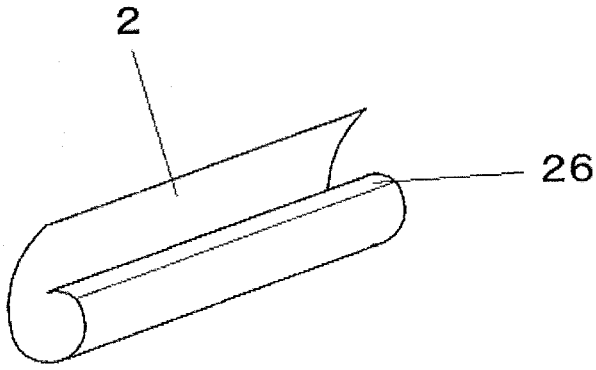
Figure 22:
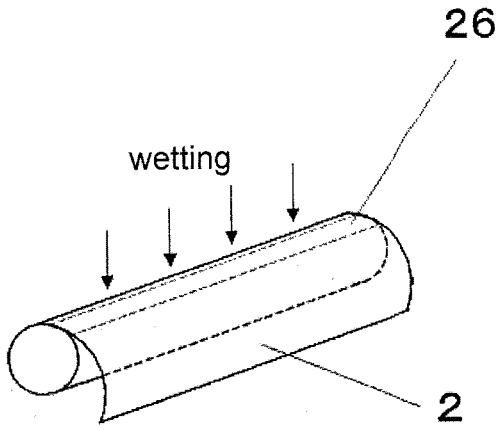
Figure 23:
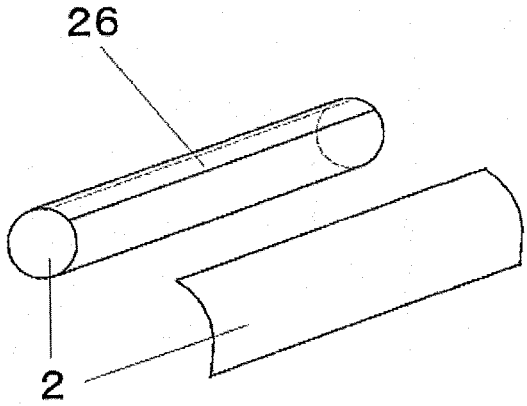
Figure 24:
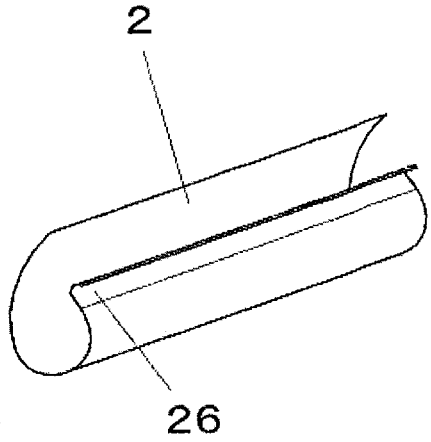
FIG. 24 is a perspective view of a wrapping paper where a portion on which an adhesive strip is formed is bent inwardly.
Figure 25:
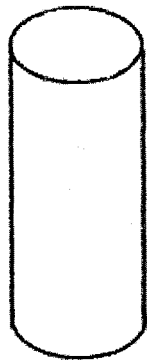
FIG. 25 is a perspective view of the tobacco filter.
Figure 26:
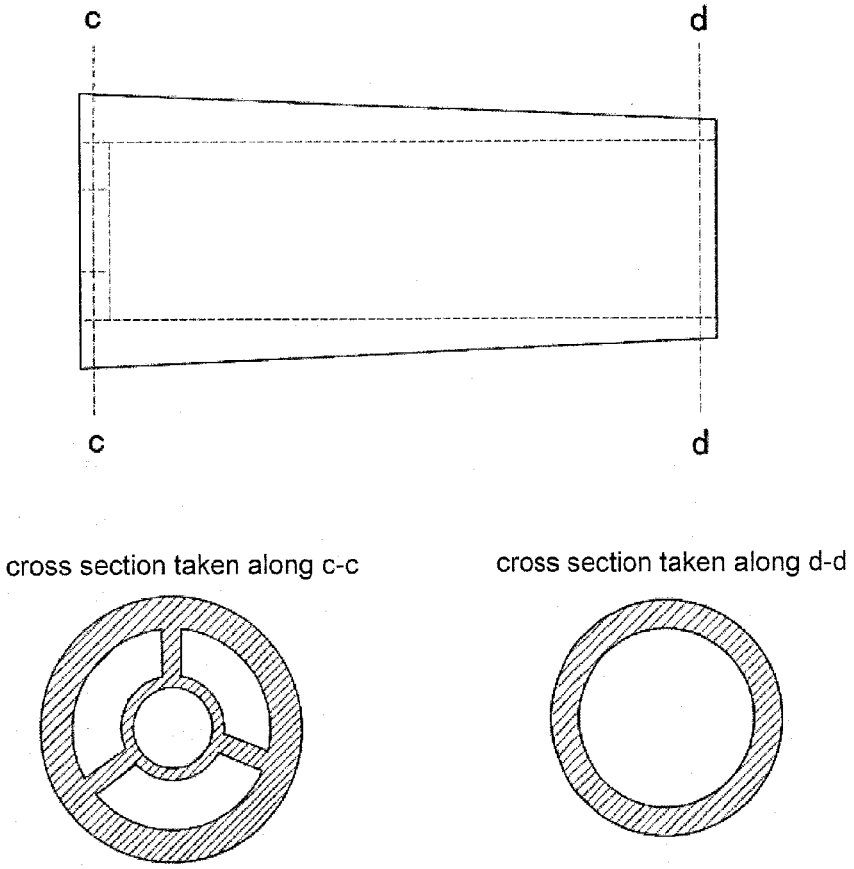
FIG. 26 is a view showing an upper surface and a cross section of the tobacco filter.
Figure 27:
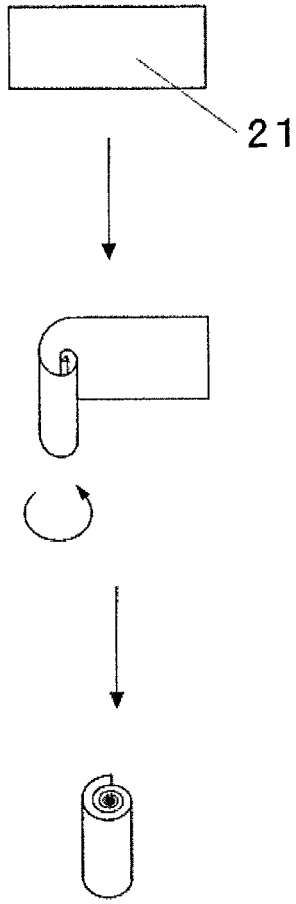
FIG. 27 is a perspective view showing steps of producing the tobacco filter.
Figure 28:
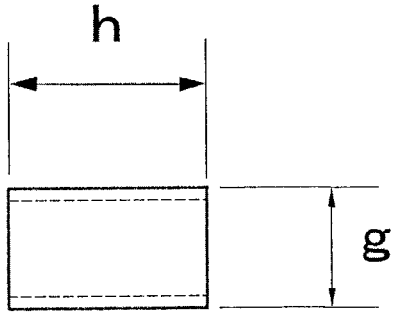
FIG. 28 is an appearance view of an aluminum-made tobacco filter.

A tobacco filter 50 shown in FIG. 11 is characterized in that grooves are formed along the longitudinal direction of an outer surface of the tobacco filter 50. A tobacco filter 60 shown in FIG. 12 is characterized in that, a diameter of an end portion of the tobacco filter 60 on a smoking plant side when a hand-rolled tobacco is produced is set larger than a diameter of an end portion of the tobacco filter 60 on a smoker side when the hand-rolled cigarette is produced.

Further, the tobacco filter of each embodiment of the present invention can be used by mounting the tobacco filter on other smoking equipment such as a smoking pipe, a water pipe, a vaporizer and the like. In this case, an end of other smoking equipment has the structure which allows mounting of the tobacco filter on the tobacco filter of each embodiment.

INDUSTRIAL APPLICABILITY

The tobacco filter according to the present invention can easily produce a hand-rolled cigarette, can suppress excessive heat conduction to a smoker's lips, and can suppress spoiling of tobacco taste during smoking. Accordingly, the tobacco filter according to the present invention is useful as one of smoking equipment.

The invention claimed is:

1. A tobacco filter for use in production of a hand-rolled cigarette by wrapping at least a portion of the filter and a smoking plant with a wrapping paper, the tobacco filter being made of an incombustible material, said tobacco filter having a smoking plant side and a smoker side opposite to the smoking plant side and comprising:

an uneven outer surface adapted to be wrapped on the outside with the smoking plant;

a hollow portion which forms a smoke channel; and an adhesion member which is made of an incombustible material which is insertable from the smoking plant side of the filter into the hollow portion during smoking, and to which at least a portion of a substance produced when the smoking plant is burnt is adhered, wherein the adhesion member includes a stopper at the smoking plant side and said stopper is adapted to prevent the adhesion member from entering an inside of a smoker's mouth during smoking, and the adhesion member has a twisted shape formed by twisting an elongated plate along a longitudinal direction.

2. The tobacco filter according to claim 1, wherein the uneven outer surface is an outer surface on which grooves are formed.

3. The tobacco filter according to claim 2, further comprising an air hole for allowing air to come through the hollow portion from an end portion of the tobacco filter which constitutes the smoker side when the hand-rolled cigarette is produced and for guiding air to the outside, wherein said air hole is formed in the tobacco filter at a position in the vicinity of the smoking plant when the hand-rolled cigarette is produced.

4. The tobacco filter according to claim 2, wherein a diameter of an end portion of the tobacco filter which constitutes the smoking plant side when the hand-rolled cigarette is produced is larger than a diameter of the other end portion of the tobacco filter which constitutes the smoker side when the hand-rolled cigarette is produced.

5. The tobacco filter according to claim 2, wherein the tobacco filter has a multi-faceted columnar profile ranging from a pentagonal columnar profile to an octagonal columnar profile.

6. The tobacco filter according to claim 1, further comprising an air hole for allowing air to come through the hollow portion from an end portion of the tobacco filter which constitutes the smoker side when the hand-rolled cigarette is produced and for guiding air to the outside, wherein said air hole is formed in the tobacco filter at a position in the vicinity of the smoking plant when the hand-rolled cigarette is produced.

7. The tobacco filter according to claim 6, wherein a diameter of another end portion of the tobacco filter which constitutes the smoking plant side when the hand-rolled cigarette is produced is larger than a diameter of the end portion of the tobacco filter which constitutes the smoker side when the hand-rolled cigarette is produced.

8. The tobacco filter according to claim 6, wherein the tobacco filter has a multi-faceted columnar profile ranging from a pentagonal columnar profile to an octagonal columnar profile.

9. The tobacco filter according to claim 1, wherein a diameter of an end portion of the tobacco filter which constitutes the smoking plant side when the hand-rolled cigarette is produced is larger than a diameter of the other end portion of the tobacco filter which constitutes the smoker side when the hand-rolled cigarette is produced.

10. The tobacco filter according to claim 9, wherein the tobacco filter has a multi-faceted columnar profile ranging from a pentagonal columnar profile to an octagonal columnar profile.

11. The tobacco filter according to claim 1, wherein the tobacco filter has a multi-faceted columnar profile ranging from a pentagonal columnar profile to an octagonal columnar profile.

12. The tobacco filter according to claim 1, wherein the hollow portion has a circular columnar shape.

13. The tobacco filter according to claim 12, wherein a surface of the hollow portion is formed of a smooth surface.

14. The tobacco filter according to claim 1, wherein the incombustible material which the tobacco filter being made of includes at least one of metal, ore, ceramics or porcelain, and the incombustible material which the adhesion member being made of includes at least one of metal, stone, glass or porcelain.

* * * * *